US008242978B2

(12) United States Patent
Mahara et al.

(10) Patent No.: US 8,242,978 B2
(45) Date of Patent: Aug. 14, 2012

(54) PLASMA DISPLAY APPARATUS AND METHOD OF DRIVING THE SAME

(75) Inventors: Yuichiro Mahara, Fujisawa (JP); Akihiro Machida, Kyonan (JP); Teruo Okamura, Yokohama (JP); Sojiro Hagihara, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 909 days.

(21) Appl. No.: 12/034,955

(22) Filed: Feb. 21, 2008

(65) Prior Publication Data

US 2009/0051625 A1 Feb. 26, 2009

(30) Foreign Application Priority Data

Aug. 20, 2007 (JP) ..... 2007-213246

(51) Int. Cl.
*G09G 3/28* (2006.01)

(52) U.S. Cl. ..... 345/63; 345/42; 345/60; 345/68; 315/169.1; 315/169.3

(58) Field of Classification Search ..... 345/60–67, 345/37, 41, 42; 315/169.1–169.4
See application file for complete search history.

(56) References Cited

U.S. PATENT DOCUMENTS 6,707,436 B2 3/2004 Setoguchi et al.
6,844,685 B2 1/2005 Lee
6,937,213 B2 8/2005 Iwasa et al.
2004/0183753 A1* 9/2004 Choi et al. ..... 345/33
2007/0103396 A1* 5/2007 Lee ..... 345/63
2007/0115219 A1* 5/2007 Inoue ..... 345/68
2008/0042935 A1* 2/2008 Kim et al. ..... 345/68
2008/0055199 A1* 3/2008 Nagaoka et al. ..... 345/60
2009/0219272 A1* 9/2009 Nakata et al. ..... 345/211

FOREIGN PATENT DOCUMENTS

JP 2000-075835 3/2000
JP 2002-328649 11/2002
JP 2002-351395 12/2002
JP 2004-62207 2/2004
JP 2004-287470 10/2004
JP 2006-349805 12/2006

* cited by examiner

*Primary Examiner* — Quan-Zhen Wang
*Assistant Examiner* — Jennifer Nguyen
(74) *Attorney, Agent, or Firm* — Brundidge & Stanger, P.C.

(57) ABSTRACT

A PDP apparatus having a driving circuit in which a circuit for applying a rising-slope waveform in a reset period, a circuit for applying a falling-slope waveform, and a clamp circuit for generating a falling waveform having a dulled waveform between the rising-slope waveform and the falling-slope waveform are comprised. The clamp circuit comprises a bidirectional switch having two FETs, and a gate feedback circuit is connected to a gate portion of the FET at a panel side. The PDP apparatus reduces a current noise occurring in a sustain electrode throughout the panel when switching the rising-slope waveform and the falling-slope waveform, thereby solving problems such as an increase of unnecessary radiation and stress on elements such as FETs on the path.

8 Claims, 10 Drawing Sheets

31
311
312
51
58
52
trp1
trn1
Vy
GND

PLASMA DISPLAY APPARATUS AND METHOD OF DRIVING THE SAME

CROSS-REFERENCE TO RELATED APPLICATION

The present application claims priority from Japanese Patent Application No. JP 2007-213246 filed on Aug. 20, 2007, the content of which is hereby incorporated by reference into this application.

TECHNICAL FIELD OF THE INVENTION

The present invention relates to a technique for a driving circuit of a plasma display panel (PDP) and a display apparatus (plasma display apparatus or PDP module, a PDP apparatus, hereinafter) using the driving circuit. More particularly, the present invention relates to a technique for a driving circuit for controlling driving waveforms.

BACKGROUND OF THE INVENTION

PDP is a display device which performs display by using electric discharges, and it is generally configured by several hundred-thousands to several million pixels. Display of general AC-type PDPs has one field of a screen in 1/60 second, and each field is configured by a plurality of subfields having different weights of luminance. Each subfield is configured by, for example, a reset period, an address period, and sustain period.

In the reset period, discharges are generated at all the cells to accumulate charges and the amount of charges in the cells is adjusted so that discharges in the subsequent address period will be smoothly performed. In the address period, a selecting pulse is applied to a scanning electrode and an address electrode to perform an address discharge for selecting a target cell to turn on (On-cell) in the display area so that charges are generated. Note that, as opposite to such system for generating a discharge at an On-cell (write addressing method), there is a system for reducing charges in a cell by generating a discharge at a target cell to turn off (Off-cell) (erase addressing method). In the sustain period, actual display is performed by turning on the cell, in which pulses are alternately applied between the scanning electrode (X) and the sustain electrode (Y) (i.e., between X-Y) at selectively discharged cells in the previous address period so that repeating discharges (sustain discharges) are performed, thereby performing grayscale expression by the number of discharges.

Conventionally, a waveform of a voltage which gradually rises (rising-slope waveform) is applied to the scanning electrode to form charges in the reset period, and subsequently, a waveform of a voltage which gradually falls (falling-slope waveform) is applied. Such a reset waveform can perform finer control as the gradient of the waveform is smaller, thereby performing stable discharges and generation of charges. As an application of the method, in each waveform of the rising-slope waveform and the falling-slope waveform, the waveform is divided to first and second waveforms having different gradients. And, the first slope is made steep and the second slope is made gentle, so that fine control is performed by the waveform of second slope having smaller gradient, thereby performing stable discharges and generation of charges (Japanese Patent Application Laid-Open Publication No. 2004-62207: Patent Document 1). In addition, in the reset waveform, a dull waveform is used (Japanese Patent Application Laid-Open Publication No. 2000-75835: Patent Document 2).

SUMMARY OF THE INVENTION

As for a reset period of a conventional AC-type and color-display PDP apparatus, according to the above-mentioned Patent Document 1, upon switching the rising-slope waveform and the falling-slope waveform, after the rising-slope waveform is raised to an attained potential, it is steeply dropped to the GND or close to that, and then the subsequent falling-slope wave form is applied. This method aims to shorten the required time period as much as possible and make the time for a reset period in each subfield short as much as possible, so that the shortened amount of time is allocated to the subsequent address period and sustain period.

Meanwhile, a current noise is generated in the sustain electrode (X) throughout a panel upon the switching, and there have been problems due to the noise such as an increase of unnecessary radiation and large stress on elements provided on the path such as FETs. In addition, the above-mentioned Patent Document 2 does not disclose any solution and a circuit configuration corresponding to the above problems.

The present invention has been made in view of the problems above. An object of the present invention is, in the technique of PDP apparatus, to provide a technique for reducing the current noise generated in the sustain electrode (X) in the reset period of a PDP apparatus, more particularly, when changing the rising-slope waveform to the falling-slope waveform.

The typical means for solving the problems of the inventions disclosed in this application will be briefly described as follows. To achieve the above object, the present invention is a technique of a PDP apparatus comprising a PDP, a driving circuit, control circuit and the like, and the PDP apparatus further comprises the technical means described below.

The PDP apparatus of the present invention comprises a driving circuit including: a circuit for applying a rising-slope waveform in a reset period; a circuit for applying a falling-slope waveform in a reset period; and a clamp circuit for generating a dull falling waveform between the rising-slope waveform and the falling-slope waveform. Further, a clamp circuit is included, which dulls waveforms of other electrodes corresponding to the switching of the rising-slope waveform and the falling-slope waveform.

The clamp circuit comprises a bidirectional switch having two FETs, and one of the FETs on the panel side has a gate connected to a gate feedback circuit. And, the gate feedback circuit includes a capacitor connected to a drain side of the FET of the panel side and an input of control signal of a gate resistance. Further, a resistance and a diode connected in parallel are connected between the gate resistance and the input of control signal, and the diode is connected forwardly to a gate signal.

According to the present invention, in the technique of PDP apparatus, it has an effect of reducing a noise generated in the sustain electrode in the reset period of the PDP apparatus.

BRIEF DESCRIPTIONS OF THE DRAWINGS

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted.

[First Embodiment]

With reference to FIG. 1 to FIG. 7D, a first embodiment of the present invention will be described. A feature of the first embodiment is particularly shown in FIG. 5 to FIG. 7, and a driving circuit for outputting a reset waveform to a scanning electrode of a PDP is shown.

<PDP Apparatus>

Figure 1:
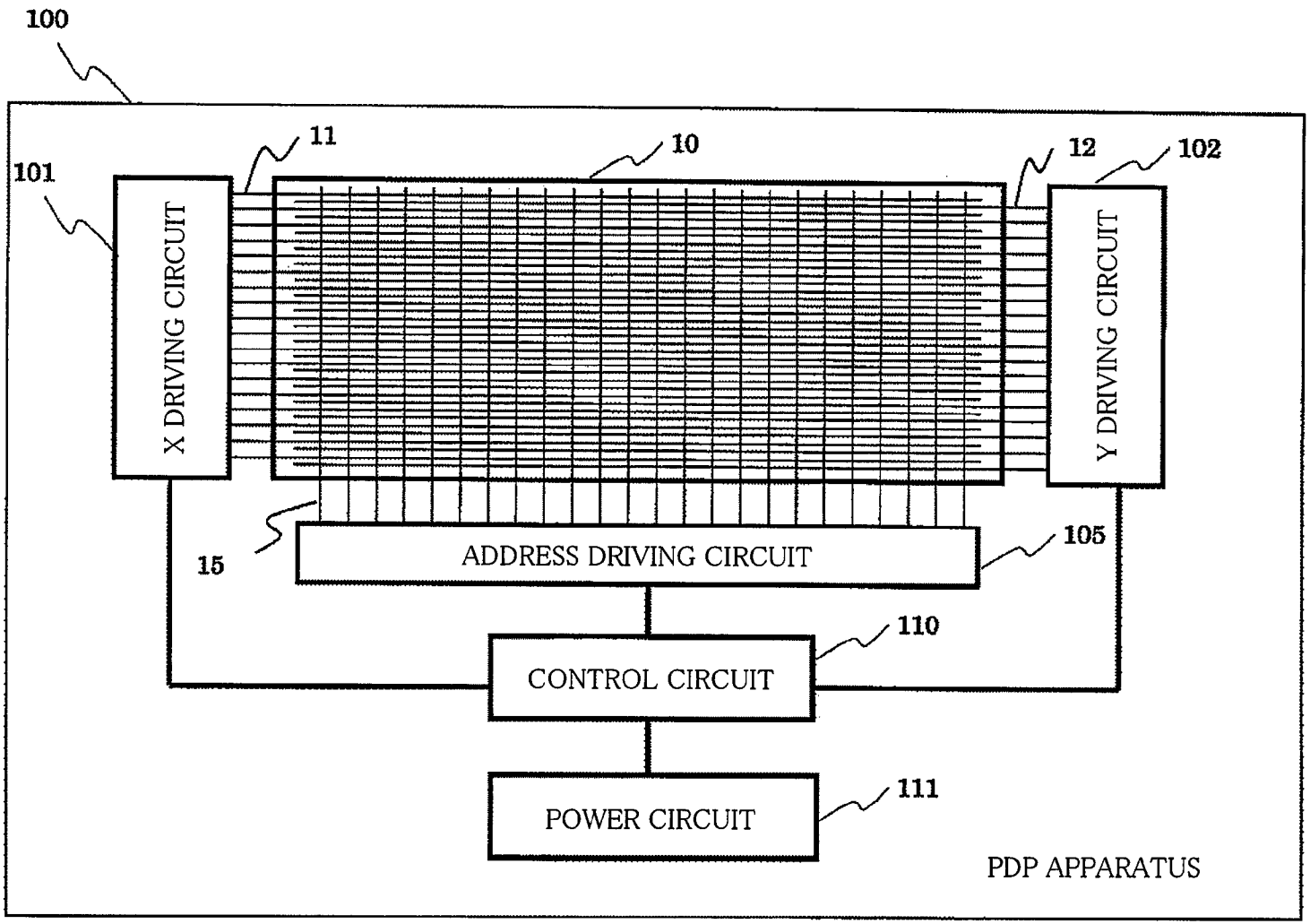
FIG. 1 is a diagram showing an entire configuration of a PDP apparatus according to an embodiment of the present invention.

First, with reference to FIG. 1, an entire configuration of a PDP apparatus (PDP module) 100 of the present embodiment will be described. The present PDP apparatus has a configuration mainly including an AC-type PDP 10 and a circuit unit for driving and controlling the PDP 10. The PDP module 100 has a configuration in which the PDP 10 is attached to and held by a chassis unit not shown, the circuit unit includes IC and the like, and the PDP and the circuit unit are electrically connected. The PDP 10 has a sustain electrode (X) 11, scanning electrode (Y) 12, and an address electrode (A) 15 respectively and correspondingly connected to a X (sustain) driving circuit 101, a Y (scan) driving circuit 102, and an address driving circuit 105, and these electrodes are driven by waveforms of corresponding driving signals. Each of the driving circuits (101, 102, 105) is connected to a control circuit 110 and driven by a control signal. The control circuit 110 controls the entire of the PDP apparatus 100, and it generates a control signal for driving the PDP 10, display data and the like based on inputted display data (image signal) and outputs the same to respective driving circuits. And, a power circuit 111 applies power to respective circuits including the control circuit 110.

<PDP>

Figure 2:
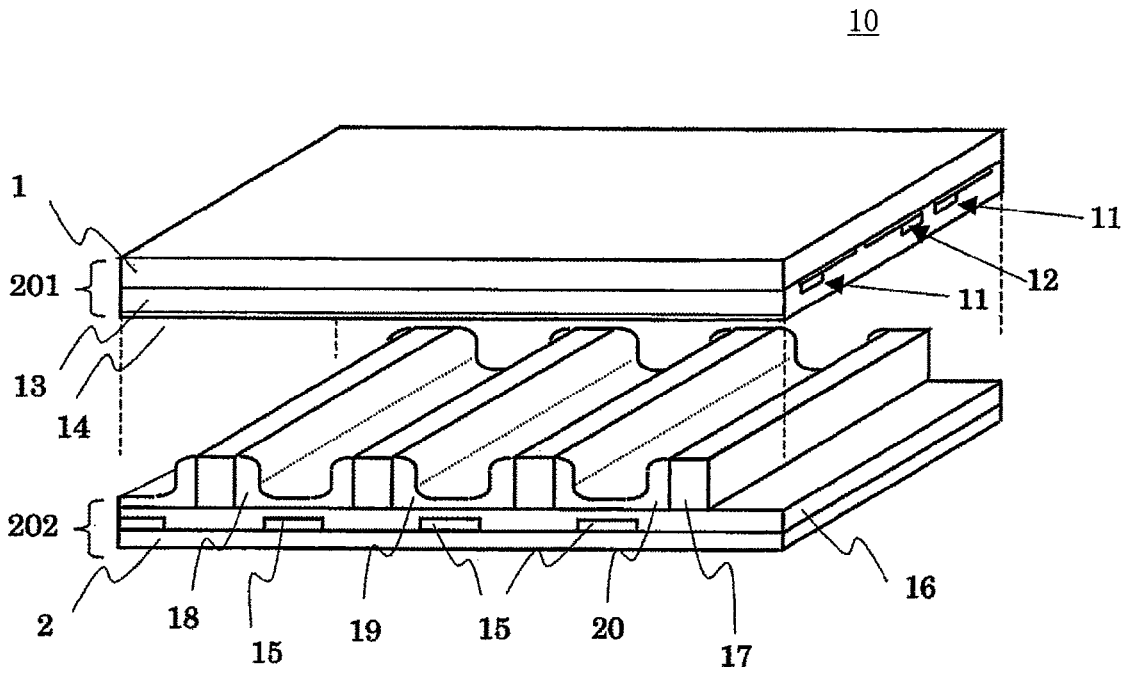
FIG. 2 is an exploded perspective view showing an example of a panel (PDP) configuration of the PDP according to the embodiment of the present invention.

Next, an example of a configuration of the PDP 10 will be described with reference to FIG. 2. The PDP 10 is mainly configured by pairing a rear unit 201 of a front substrate 1 made of glass and a front unit 202 of a rear substrate 2. In the rear unit 201, the front substrate 1 has a plurality of sustain electrodes (X) 11 and scan electrodes (Y) 12 which are extending in parallel in a first direction (lateral direction) with a predetermined space and alternately and repeatedly arranged in a second direction (longitudinal direction) for performing discharges repeatedly. These electrode groups (11, 12) are covered by a first dielectric layer 13, and a surface of the first dielectric layer 13 facing to a discharge space is further covered by a protective layer 14 of MgO and the like. The protective layer 14 is made of a material having a role for protecting the first dielectric layer 13 and emitting a large amount of secondary electrons. The sustain electrode (X) 11 and the scan electrode (Y) 12 are formed by, for example, a linear bus electrode made of a metal and a transparent electrode electrically connected to the bus electrode and forming a discharge gap between adjacent electrodes, respectively.

In the front unit 202, the rear substrate 2 has the address (A) electrode 15 arranged substantially orthogonally to the sustain electrode (X) 11 and the scan electrode (Y) 12, and further, the address (A) electrode 15 is covered by a dielectric layer 16. Barrier ribs 17 are arranged on both sides of the address (A) electrode 15 so that cells in a column direction are divided. Further, various types of phosphors 18, 19, 20 which generate visible lights of red (R), green (G), blue (B) by excitation by ultraviolet ray are applied separately per a column on the dielectric layer 16 and side surfaces of the barrier rib 17. The rear unit 201 of the front substrate 1 and the front unit 202 of the rear substrate 2 are attached to each other so as to contact the protective layer 14 and an upper surface of the barrier rib 17, and a discharge gas such as Ne—Xe is encapsulated in the discharge space, thereby forming the PDP 10.

Each of the electrodes (11, 12) forms a pair with another electrode adjacent on one side (12, 11) along the second direction so that a row of (X, Y) is formed, thereby generating a discharge in the discharge gap of each cell of the row. The address electrode (A) 15 further crosses the row, thereby forming a cell corresponding to an area divided by the barrier ribs 17. A pixel is formed by a set of cells of R, G, B.

The PDP 10 may have various configurations corresponding to other driving methods than the above-said example, and the feature of the present invention and embodiments are applicable to these various configurations. As another configuration example of the PDP, for example, a configuration of box-type ribs in which lateral ribs dividing cells in the column direction are provided in addition to longitudinal ribs. Further, there is another configuration in which respective electrodes (11, 12) for display are forming pairs with another type of electrodes (12, 11) adjacent on both sides thereof so that rows are formed, and each cell of the row is capable of discharge (so-called ALIS configuration). Further, there is still another configuration in which same sustain electrodes 11 and same scanning electrodes 12 are arranged adjacently to one another on a slit side where discharges are not performed, that is, respective electrodes (11, 12) are reversely and repeatedly arranged as (X, Y), (Y, X), . . . .

Figure 3:
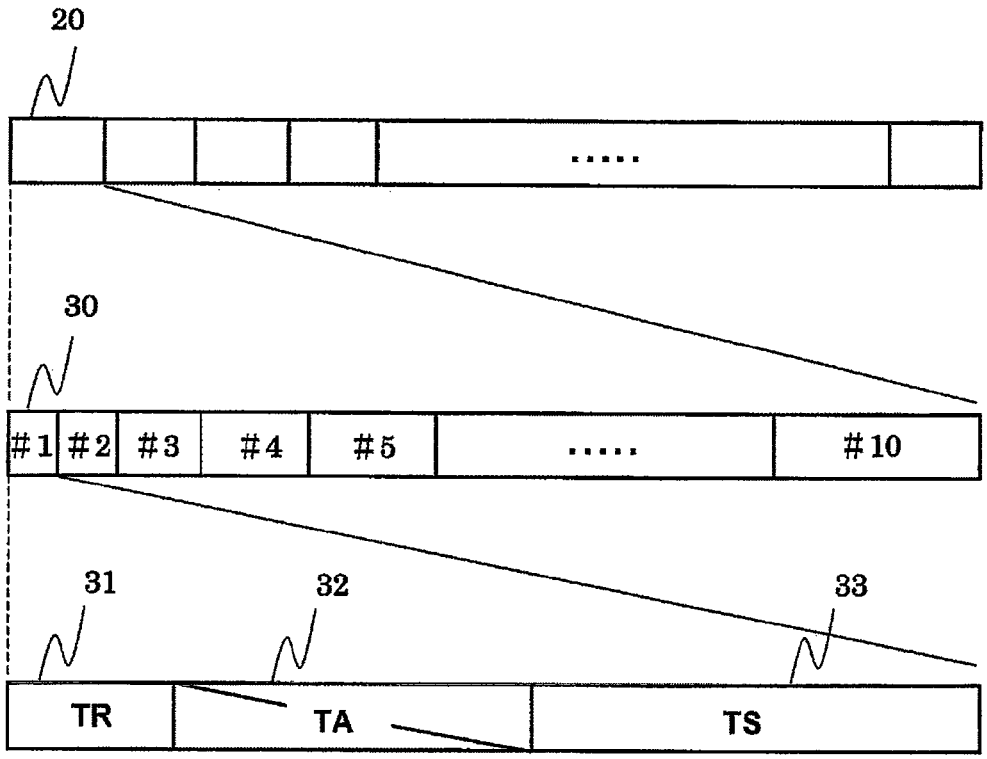
FIG. 3 is a diagram schematically showing a configuration of fields of the PDP according to the embodiment of the present invention.
Figure 4:
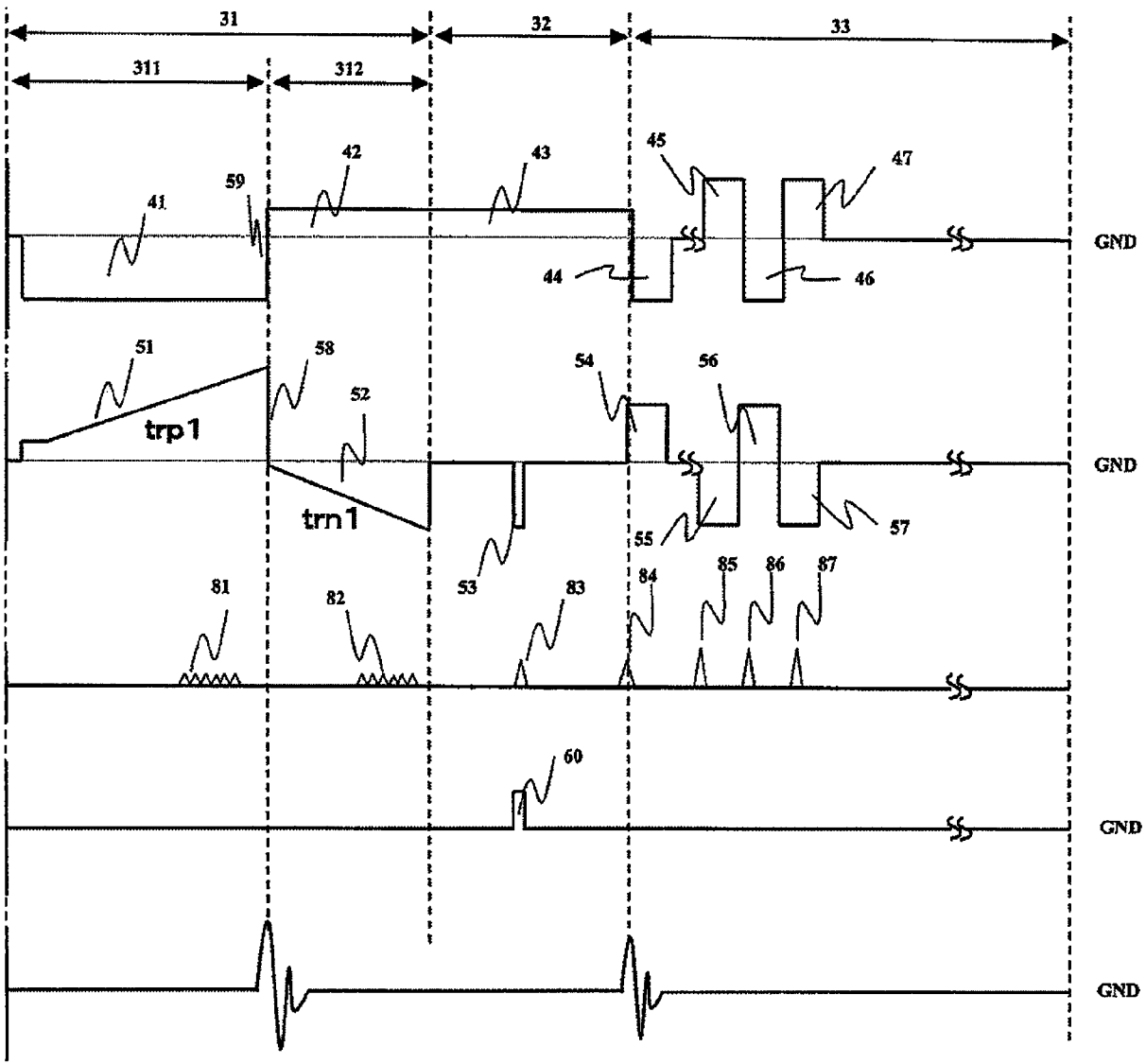
FIG. 4A is a diagram showing an example of a voltage waveform of the PDP apparatus according to the embodiment of the present invention.
FIG. 4B is a diagram showing an example of a voltage waveform of the PDP apparatus according to the embodiment of the present invention.
FIG. 4C is a diagram showing an example of a discharge emission of the PDP apparatus according to the embodiment of the present invention.
FIG. 4D is a diagram showing an example of a voltage waveform of the PDP apparatus according to the embodiment of the present invention.
FIG. 4E is a diagram showing an example of a current waveform of the PDP apparatus according to the embodiment of the present invention.

Next, a configuration and a method of driving for image (field) display of a display area of the PDP 10 will be described with reference to FIG. 3. One field 20 is displayed in 1/60 second. One field 20 is configured by a plurality of (in the present example, #1 to #10 of) subfields (SFs) 30 divided. Each subfield is formed by a reset period TR 31, an address period TA 32, and a sustain period TS 33. Each subfield 30 of the field 20 is given a weight of a length (the number of discharges) of the TS 33, and grayscales are expressed by combinations of turning on/off of the respective subfields. The method shown in FIG. 3 is an example of "address/display period separation method." In other words, according to the method, On/Off of the cell is selected by a discharge of an address operation in TA 32, and the cell is turned on/off by a discharge of a sustain operation in the next TS 33, thereby performing the display.

In TR 31, as well as erasing charges formed by the previous TS 33, an operation (reset operation) is performed for rearrangement/adjustment of charges in the cell for purposes of support/preparation of a discharge (address discharge) in the subsequent TA 32. In TA 32, a discharge (address discharge) for selectively determine a cell to emit (on-target cell) in the SF 30 is performed. In the subsequent TS 33, discharges are repeatedly generated between the scan electrode (Y) 12 and the sustain electrode (X) 11 (Y-X) at the cell selected in the previous TA 32, thereby emitting the cell.

<Voltage Waveform>

Next, an example of voltage waveforms for driving the PDP 10 will be described with reference to FIG. 4A to FIG. 4D. FIGS. 4A, 4B, 4D are voltage waveforms (Vx, Vy, Va) to be applied to the sustain electrode (X) 11, scan electrode (Y) 12, address (A) electrode 15, respectively, and FIG. 4C shows a discharge emission (P) in the voltage application. To further divide the TR 31, it is configured by, for example, a first period 311 and a second period 312.

First, in TR 31, by the Vy of FIG. 4B, a rising-slope waveform (trp1) 51 is applied in the first period 311 as a waveform for forming charges in all the cells by Vy. Further, subsequently, in the second period 312, a falling-slope waveform (trn1) 52 is applied as a waveform for erasing the charges formed by Vy with remaining a necessary amount. By Vx of FIG. 4A, waveforms 41, 42 are applied for making respective potential differences from the rising-slope waveform (trp1) 51 and the falling-slope waveform (trn1) 52 larger so that a discharge between (X-Y) is generated.

In the next TA 32, by Vx of FIG. 4A and Vy of FIG. 4B, as waveforms for generating discharges (address discharge) to determine cells to display in the row direction, for example, a scan pulse 53 for an arbitral N-th row and an X voltage 43 for forming wall charges by the present discharge are applied. The scan pulse 53 is applied in sequence with shifting application timing per a row (scanning line).

Further, in TA 32, by Va of FIG. 4D, an address pulse 60 is applied to a cell which is desired to discharge along with the scan pulse 53, thereby generating a discharge (address discharge) between the scan electrode (Y) 12 and the address (A) electrode 15 (Y-A), and then it is advanced to formation of wall charges between the corresponding sustain electrode (X) 11 and the scan electrode (Y) 12.

Subsequently, in TS 33, by Vx of FIG. 4A and Vy of FIG. 4B, sustain pulses (44 to 47, 54 to 57) are applied. For example, the sustain pulse 44 of Vx having a first negative polarity and the sustain pulse 54 of Vy having a first positive polarity are first applied, and subsequently, the sustain pulse 45 of Vx having a second positive polarity and the sustain pulse 55 of Vy having a negative polarity are applied. After that, similarly, repeated waveforms are repeatedly applied for times corresponding to the weighting of the subfield 20 with alternately reversing the polarities. P of FIG. 4C shows emissions of the cell by discharges by (Vx, Vy, Va).

In the first period 311 of TR 31, by the rising-slope waveform (trp1) 51 of Vy, a weak write discharge 81 is generated. And, in the second period 312, by the falling-slope waveform (trn1) 52, also a weak discharge 82 is generated. Waveforms having voltages changing gradually such as these waveforms (51, 52) make weak discharges (81, 82), and thus the amount of emission is small. In the subsequent TA 32, an address discharge 83 is generated by the scan pulse 53 and the address pulse 60. Further, in TS 33, by the above-said sustain pulses, respective sustain discharges (84 to 87) are generated.

Although not clearly illustrated in FIGS. 4A to 4E, dull waveforms are used for the falling waveform 58 between the rising-slope waveform (trp1) 51 and the falling-slope waveform (trn1) 52 applied to the scanning electrode (Y) 12, and the rising waveform 59 between the waveforms 41, 42 applied to the sustain electrode (X) 11. Further, also a dull waveform is used for the waveform to be applied to the scanning electrode (Y) 12 when TA 32 is switched to TS 33. Ix(1) of FIG. 4E shows a waveform of a current to flow in the sustain electrode (X) 11. The reason of using dull waveforms is that, if a steep waveform is used instead of a dull waveform when a voltage of vy is dropped when switching the rising-slope waveform and the falling-slope waveform and when the address period TA 32 is switched to the sustain period TS 33, a current noise is generated at a switch SW24 of an X driving circuit shown in FIG. 10 becomes large. Respective current noises are generated because the potential difference of the voltages applied to the sustain electrode (X) and the scan electrode (Y) is large. This generation of current noise has been a cause of increase of unnecessary radiation and increase of stress on elements such as FETs.

<Operation>

Next, with reference to FIG. 5 and FIG. 6, the present embodiment will be described. First, a configuration of the Y driving circuit 102 will be described. As a circuit block, the Y driving circuit 102 of FIG. 5 comprises: an output circuit of rising-slope waveform 300; an output circuit of falling-slope waveform 301; a GND clamp circuit 302; and a scan driver 303, and the like. Current paths 200, 201, 202 show paths corresponding to switching of switches in the circuit. The current path 200 shows an output of the rising-slope waveform, the current path 201 shows an output of the falling-slope waveform, and the current path 202 shows an output of switching from the rising-slope waveform to the falling-slope waveform.

The output circuit of rising-slope waveform 300 outputs the rising-slope waveform (trp1) 51 in TR 31 of FIG. 4B and the attained voltage thereof is Vs+V1. By opening a switch SW5, a current flows into a base of a transistor so that a current flows into a collector and an emitter, thereby outputting the rising-slope waveform. The gradient of the rising-slope waveform is changed according to the amount of current flowing into the base of the transistor. On/Off of the switch SW5 is performed intermittently and, the time period of On/Off is changed, thereby controlling the gradient.

A resistance R3 is connected to the output circuit of falling-slope waveform 301, and to the resistance R3, a switch SW8 is provided, so that the flowing current changes according to the resistance value, thereby controlling the gradient of the waveform. Generally, the larger the resistance value is, the gentler the gradient is, and the smaller the resistance value is, the steeper the gradient is. The output circuit of falling-slope waveform 301 outputs the falling-slope waveform (trn1) 52 in TR 31 of FIG. 4B, and the attained voltage thereof is V2.

The GND clamp circuit 302 drops a potential at a point A to the GND potential by simultaneously turning on switches SW6 and SW7. The potential of the point A is shifted to the positive side when the rising-slope waveform is outputted, and the potential is shifted to the negative side when the falling-slope waveform is outputted. Accordingly, so as not to make the potential of the point A go through to the GND, the GND clamp circuit 302 comprises a bidirectional switch. The GND clamp circuit 302 outputs the falling waveform 58 upon switching from the rising-slope waveform (trp1) 51 to the falling-slope waveform (trn1) 52 in TR 31 of FIG. 4B.

The scan driver 303 is a circuit for applying the scan pulse to one scanning electrode (Y) 12, and a circuit portion for driving 1-bit (one line of the scanning electrode 12) of the integrated circuits is shown. In TA 32, by turning on a switch SW1, a scan pulse voltage Vsc is applied to the scanning electrode (Y) 12, and at this time, the waveform in TA 32 of FIG. 4B is outputted. The scan pulse 53 has a potential same as that of the source voltage V2. The ON side of the switch SW2 is mainly used in other periods, so that the voltage applied to the scan driver 303 is outputted to the scanning electrode as it is, thereby outputting the waveform in TS 33 of FIG. 4B at this time. The sustain pulses 54, 56 have the source voltage Vs, and the sustain pulses 55, 57 have the source voltage V2.

The Y driving circuit 102 switches: a source voltage V1 by the switch SW5; the source voltage V2 by the switch SW8; and the ground GND by the switches SW6, SW7, thereby determining a potential V3 at the point A. A capacitor C1 is charged to Vs by a switch SW10 and the switches SW6, SW7. By interposing the capacitor C1 after the potential V3 at the point A, a voltage of V3+Vs is generated at a point B. The potential V3 at the point A is outputted to the scan driver 303 by turning on a switch SW4, and a voltage V3+Vs is outputted to the scan driver 303 by turning on a switch SW3. Vs is a sustain voltage and it is outputted upon turning on the switch SW10. The polarity of Vs controlled by the switch SW10 is positive, and the polarity of V2 controlled by the switch SW8 is negative because it is an output voltage of the falling-slope waveform. Vs and V2 are respectively controlled not to be simultaneously turned on.

The circuit for outputting the slope waveforms of the reset waveform in TR 31 comprises: the output circuit of rising-slope waveform 300 which is operated by opening the switch SW5; the output circuit of falling-slope waveform 301 which is operated by turning on an internal switch; and the GND clamp circuit 302 which short-circuits to the GND by turning on the switches SW6, SW7 upon switching of the rising-slope waveform and the falling-slope waveform. The current is controlled by the respective output circuits of slope waveform (300, 301), thereby changing the gradients of the slope waveforms. The rising-slope waveform (trp1) 51 in TR 31 as shown in FIG. 4B is outputted through the current path 200 by opening the switch SW5 of the output circuit of rising-slope waveform 300, the falling waveform 58 upon switching the rising-slope waveform (trp1) 51 to the falling-slope waveform (trn1) 52 in TR 31 is outputted through the current path 202 by turning on the switches of the GND clamp circuit 302, and the falling-slope waveform (trn1) 52 is outputted through the current path 201 by turning on the internal switch of the output circuit of falling-slope waveform 301.

The GND clamp circuit 302 has resistances R5, R6 which are gate resistances. The switches SW6, SW7 use FETs (field effect transistors), and to the gate portions of the FETs, a gate feedback circuit comprising a capacitor C5, a resistance R4, and a diode D5, which is the feature of the present invention is connected. To show the circuit configuration, C5 is connected to the drain side of the FET and an input side of a control signal of R5, and further, R4 and D5 connected in parallel are connected to the input side of a control signal of R5. Since C5 and R4 makes a CR circuit, a rising waveform of the gate is dulled by the period of a time constant T of the C5 and R4. For example, when R4 is 500Ω and C5 is 1000 pF, the rising waveform of the gate is dulled by T=R4×C5=500 ns. The FET is turned on when a gate voltage applied to the gate reaches to a constant voltage, and then the drain and source are conducted. By dulling the applied gate voltage, the time to make the FET to the On state becomes 100 ns to 1 μs. As for setting of the time to be the On state, there are problems that, when it is 100 ns or less, the current noise is not reduced, and when it is 1 μs or more, the reset period TR 31 becomes longer. Therefore, the control is performed in the above described manner.

D5 makes the rising of the gate voltage dull, and it doesn't make the falling of the gate voltage dull. D5 is connected to the gate side by its anode (+) and connected to the control signal side by its cathode (−). When turning on the FET, the gate voltage diverts D5 and get through R4 and R5, and is applied to the gate portion with a delay by being charged on C5. And, the relationship of R4 and R5 is R4>R5 so as not to flow a current to D5 through R4. When turning off the FET, the gate voltage is outputted through D5 without getting through the CR circuit.

Next, with reference to FIG. 6, a configuration of the X driving circuit 101 for the sustain electrode (X) 11 will be described. Current paths 400 to 402 are shown corresponding to switching of the switches of the circuit.

In the X driving circuit 101, a point G is connected to the GND, and voltages of Vs and −Vs are generated by interposing capacitors C21, C22. The voltage Vs is outputted by turning on a switch SW22, and the voltage −Vs is outputted by turning on a switch SW 23. Vs and −Vs are sustain power sources and respectively turn on switches SW20, SW21, and are outputted through the current paths 400, 401. The sustain pulses 45, 47 are Vs, the sustain pulses 44, 46 are −Vs. The waveform 41 in FIG. 4A which is a negative pulse to the rising-slope waveform (trp1) 51 in TR 31 turns on the switch SW 23 and is outputted through the current path 401. The waveform 42 in FIG. 4A which goes to the positive side to the falling-slope waveform (trn1) 52 turns on a switch SW24 from a power voltage VS of a circuit 500 and is outputted through the current path 402. At this time, the switches SW22 and SW23 are turned off.

In the circuit 500, R15 is a gate resistance. The switch SW24 uses an FET and has a gate feedback circuit including a capacitor C15, a resistance R14, and a diode D15 to a gate portion. The circuit 500 has a circuit configuration and operations same as the GND clamp circuit 302 where the rising of the gate is made dull and the time to make the FET to the On state is 100 ns to 1 μs.

Herein, although it is a repeat of the description, the current paths of the X, Y driving circuits to the voltage waveform in TR 31 will be described. Output portions of the X, Y driving circuits are connected via the panel. First, in the first period 311 in TR 31, the output is made from the current path 200 of the Y driving circuit in FIG. 5 and goes through the current path 401 of the X driving circuit in FIG. 6 via the panel. When the period is switched to the second period 312 in TR 31, the output goes through the current path 202, and then the current path is shifted to the current path 201. At this time, while the X driving circuit outputs via the current path 402, when the periods 311 and 312 are switched, since a potential difference between the voltages to be applied to the sustain electrode (X) 11 and the scanning electrode (Y) 12 is large, a current noise is generated at the switch SW24 which controls the output of the current path 402.

Figure 6:
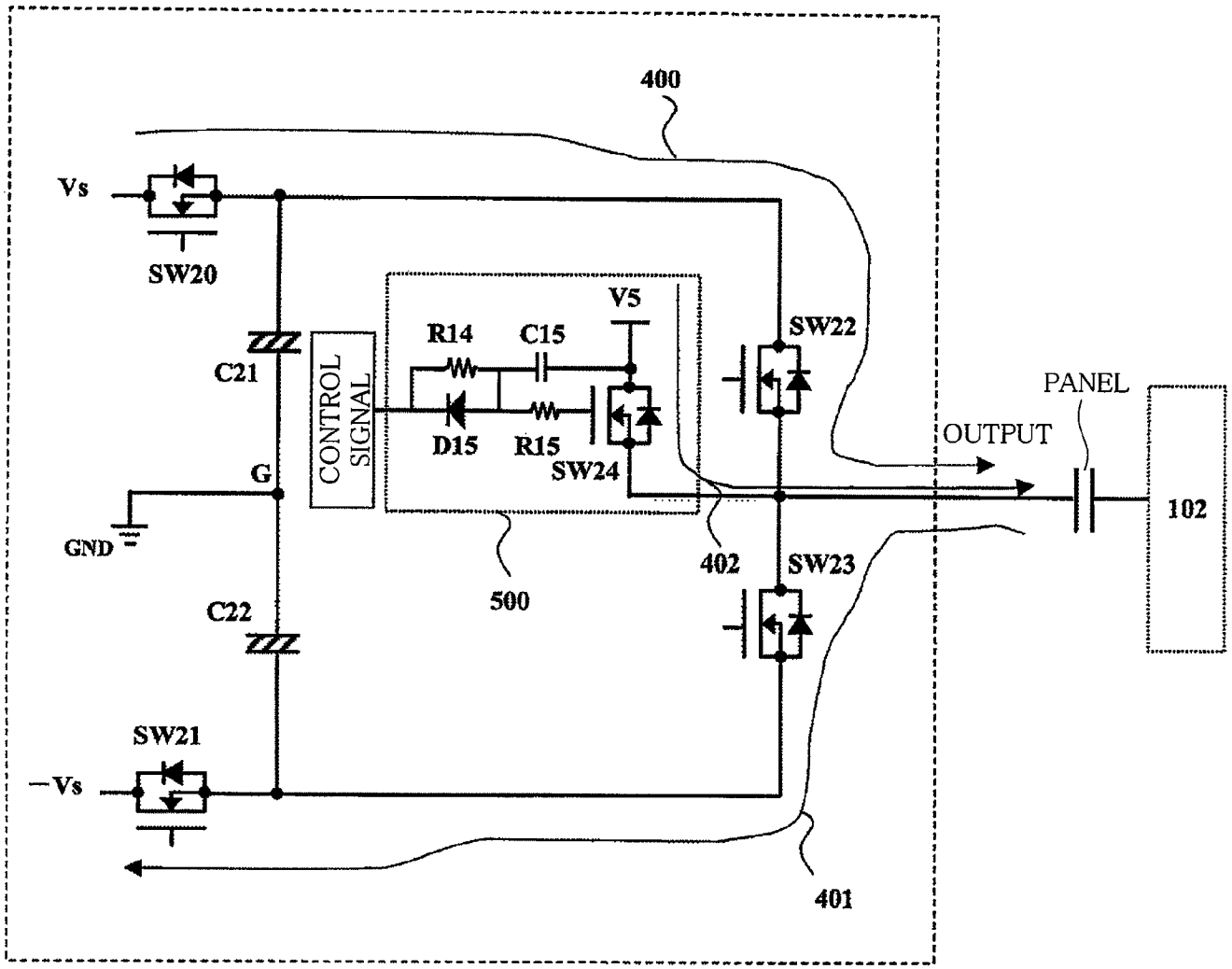
FIG. 6 is a diagram showing a schematic configuration of a sustain driving circuit of the PDP apparatus according to the first embodiment of the present invention.
Figures 7A, 7B, 7C, 7D:
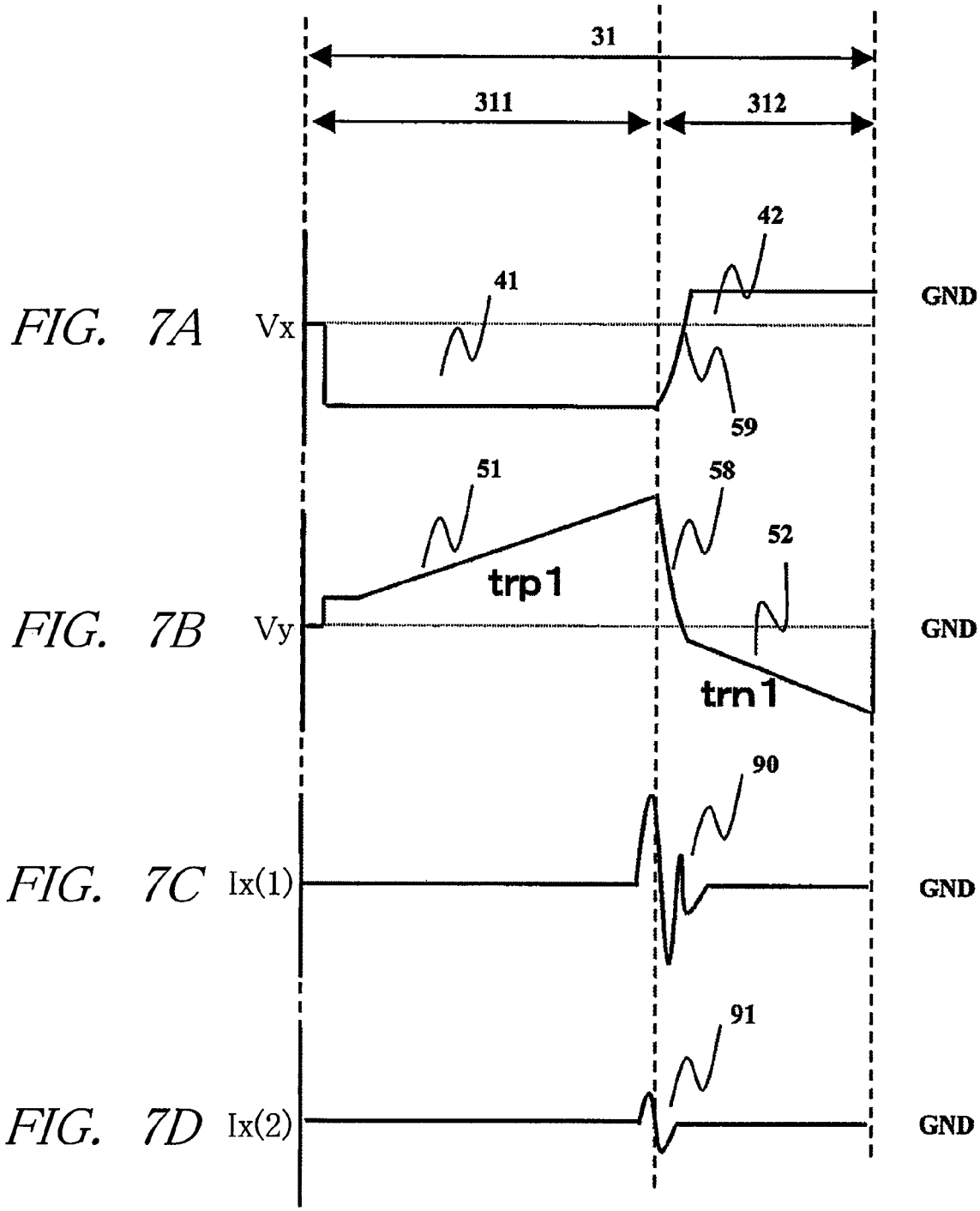
FIG. 7A is a diagram showing a voltage waveform of the PDP apparatus according to the first embodiment of the present invention.
FIG. 7B is a diagram showing a voltage waveform of the PDP apparatus according to the first embodiment of the present invention.
FIG. 7C is a diagram showing a current waveform of the PDP apparatus according to the first embodiment of the present invention.
FIG. 7D is a diagram showing a current waveform of the PDP apparatus according to the first embodiment of the present invention.

With reference to FIG. 7, a current noise which is generated in the electrodes of the PDP 10 is described. FIGS. 7A, 7B show voltage waveforms (Vx, Vy) to be applied to the sustain electrode (X) 11 and the scanning electrode (Y) 12 in TR 31 of the SF 30. By Vx of FIG. 7A, the rising waveform 59 upon switching of the waveform 41 and the waveform 42 when the gate feedback circuit is connected to the circuit 500 is shown. By Vy of FIG. 7B, the falling waveform 58 upon switching of the rising-slope waveform and the falling-slope waveform when the gate feedback circuit is connected to the GND clamp circuit 302 is shown. Ix(1) of FIG. 7C is a current waveform flowing in the sustain electrode (X) 11 before connecting the gate feedback circuit which is the present invention. At the falling of the switching of the rising-slope waveform and the falling-slope waveform of Vy, a current noise 90 is generated at SW24 of the X driving circuit of FIG. 6. Ix(2) of FIG. 7D is a current waveform flowing in the sustain electrode (X) 11, and shows a current noise 91 generated at SW 24 upon the falling of the switching of the rising-slope waveform and the falling-slope waveform of Vy. By making the rising of Vx and falling of Vy dull, the voltage variation between both electrodes is mitigated, and the noise is mitigated to be less than the current noise 90 of Ix(1) in FIG. 7C.

[Second Embodiment]

Figure 8:
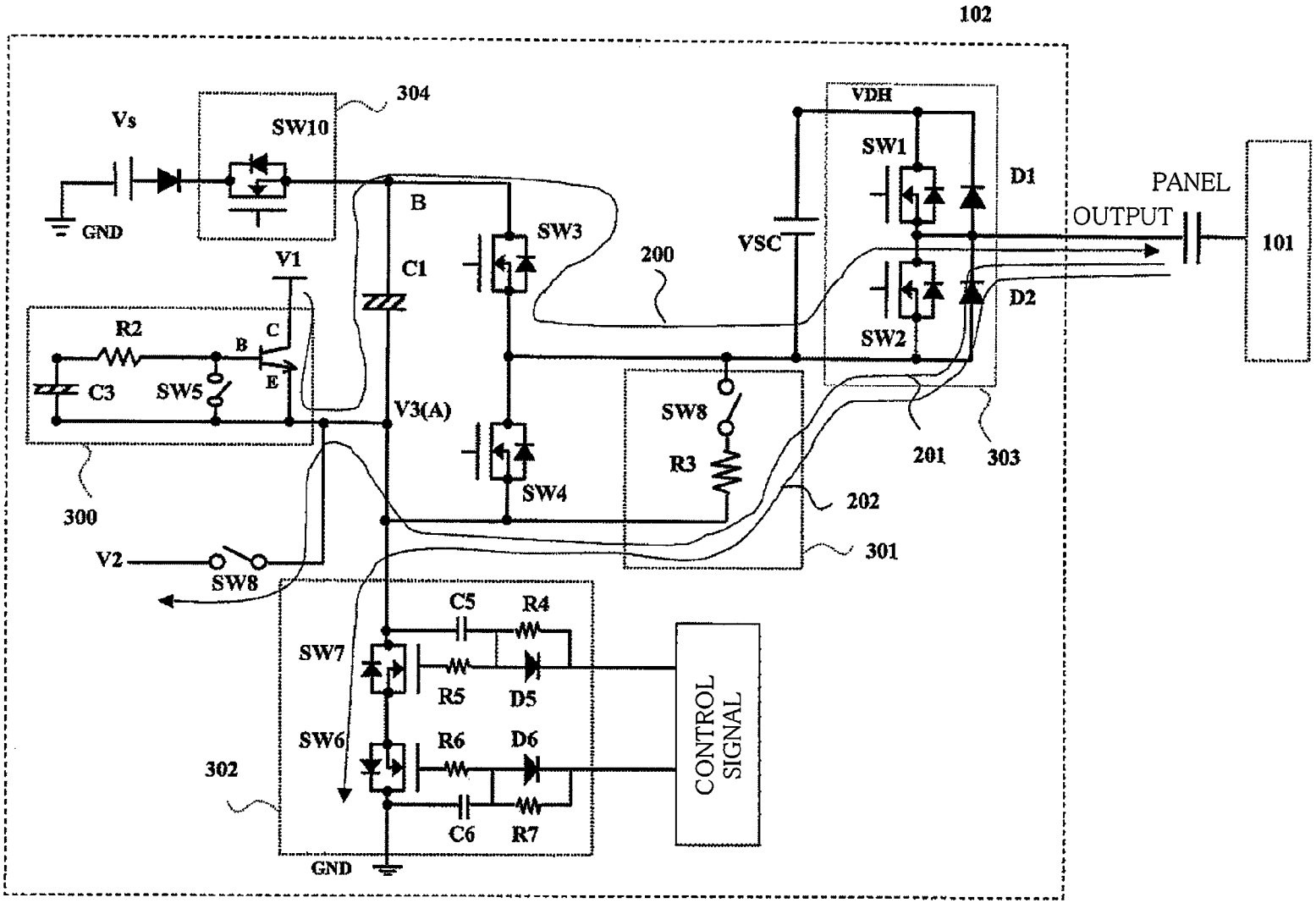
FIG. 8 is a diagram showing a schematic configuration of a PDP apparatus according to a second embodiment of the present invention.
Figures 9A, 9B, 9C, 9D:
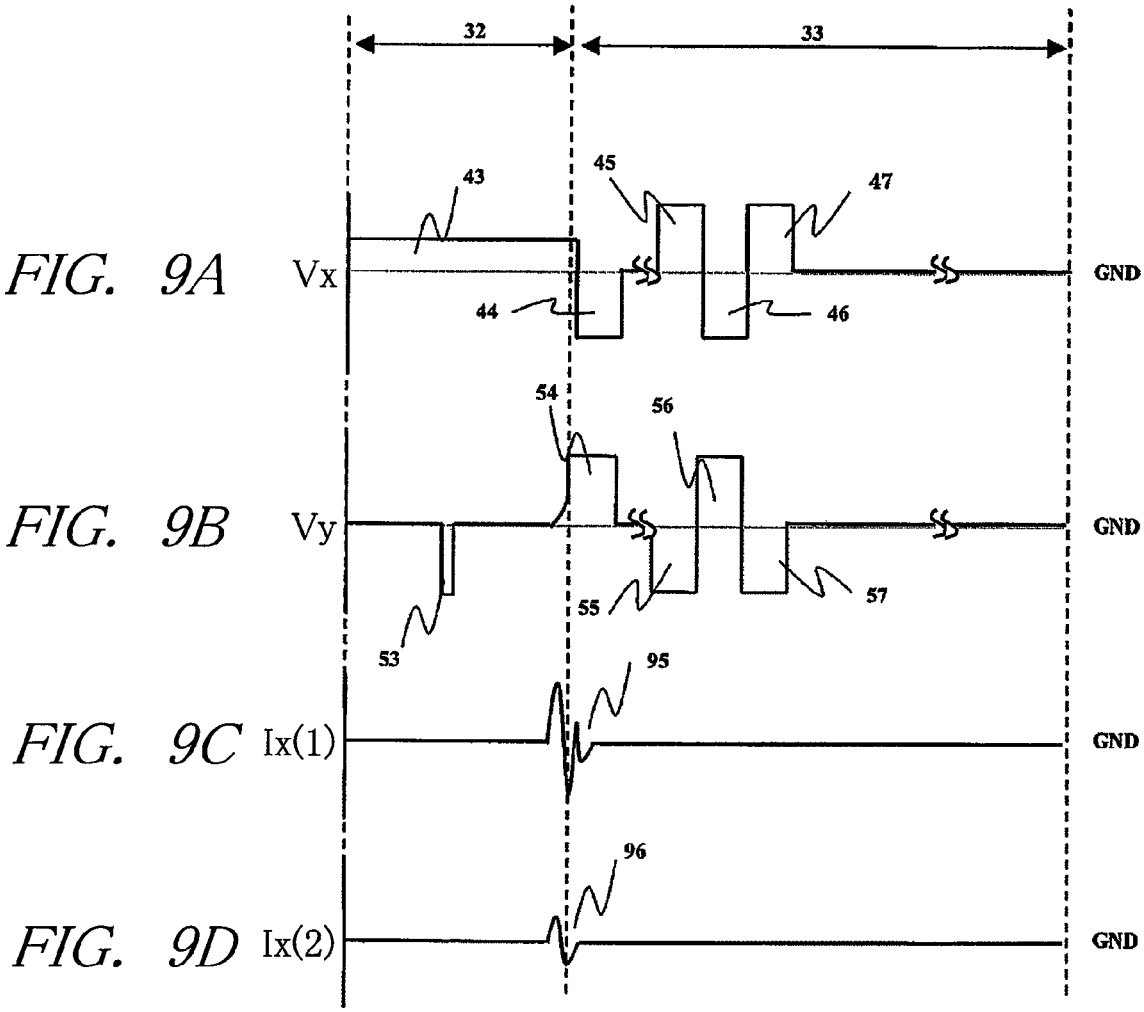
FIG. 9A is a diagram showing a voltage waveform of the PDP apparatus according to the second embodiment of the present invention.
FIG. 9B is a diagram showing a voltage waveform of the PDP apparatus according to the second embodiment of the present invention.
FIG. 9C is a diagram showing a current waveform of the PDP apparatus according to the second embodiment of the present invention.
FIG. 9D is a diagram showing a current waveform of the PDP apparatus according to the second embodiment of the present invention.

Next, with reference to FIG. 8, a second embodiment of the present invention will be described. As shown in FIG. 8, a gate feedback circuit is connected to each of the switches SW6, SW7. FIG. 9A and FIG. 9B show voltage waveforms (Vx, Vy) to be applied to the sustain electrode (X) 11 and the scanning electrode (Y) 12 in TA 32, TS 33 of SF 30, respectively, which are same as FIG. 4A and FIG. 4B. Ix(1) of FIG. 9C is a current waveform which flows in the sustain electrode (X) 11 before connecting the gate feedback circuit to the switch SW6, and it shows a current noise 95 which occurs at SW24 of the X driving circuit of FIG. 6 upon switching from TA 32 to TS 33. Ix(2) of FIG. 9D is a current waveform which flows in the sustain electrode (X) 11 when the gate feedback circuit is connected to the switch SW6, and it shows that a current noise 96 occurring in the switching from TA 32 to TS 33 is reduced to be less than the current noise 95 in Ix(1) of FIG. 9C.

[Third Embodiment]

Next, with reference to FIG. 10, a third embodiment of the present invention will be described. In the Y driving circuit 102 of the third embodiment in FIG. 10, similarly to the Y driving circuit of the first embodiment 1 in FIG. 5, the output circuit of rising-slope waveform 300, the output circuit of falling-slope waveform 301, the GND clamp circuit 302, and the scan driver 303 are included as a circuit block. Vs and −Vs are sustain voltages. Current paths 210, 211, 212 show paths corresponding to switching of the switches in the circuit. The current path 210 shows an output of rising-slope waveform, the current path 211 shows an output of falling-slope waveform, and the current path 212 shows an output upon switching from the rising-slope waveform to the falling-slope waveform.

Figure 5:
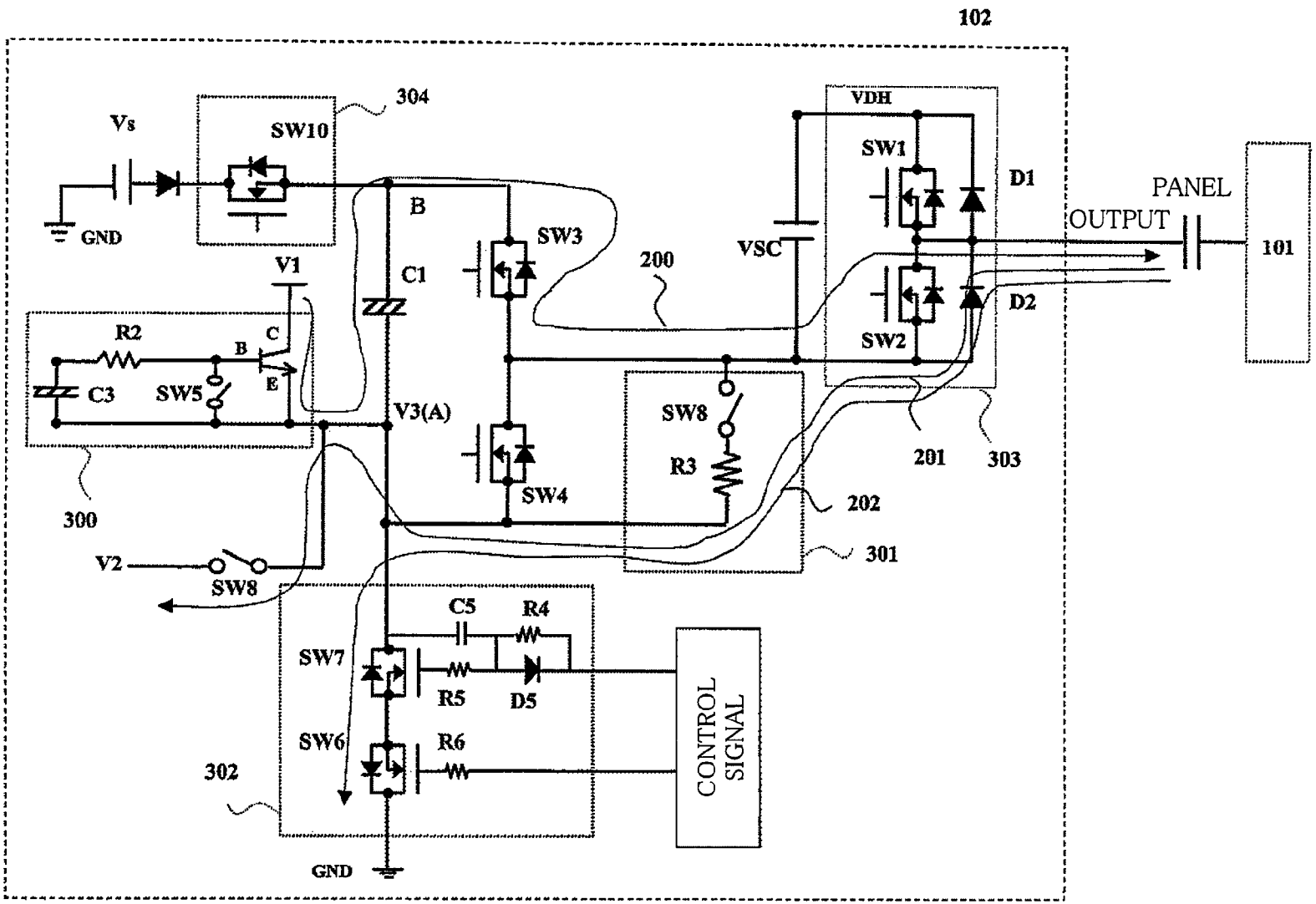
FIG. 5 is a diagram showing a schematic configuration of a scan driving circuit (driver) of a PDP apparatus according to a first embodiment of the present invention.
Figure 10:
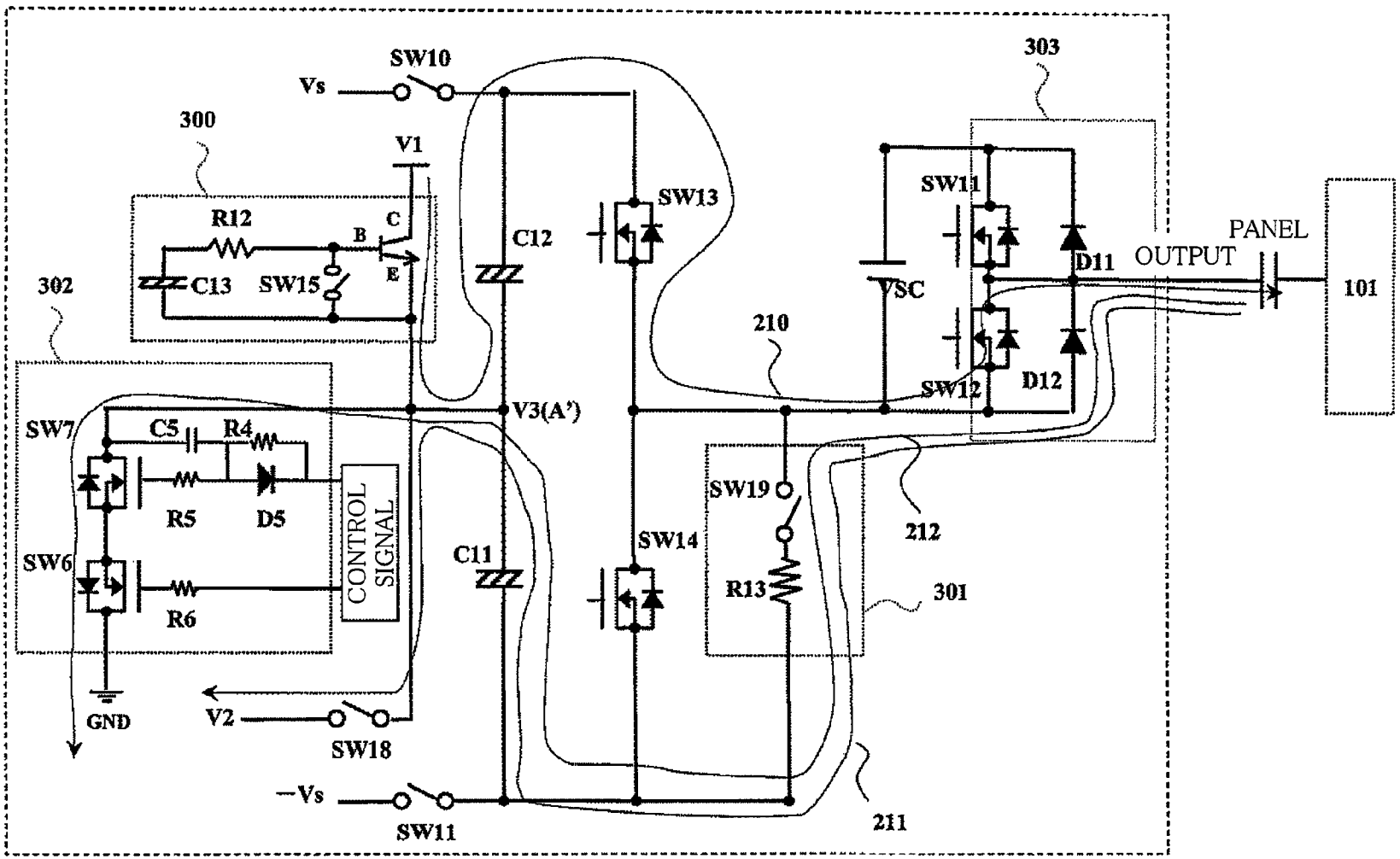
FIG. 10 is a diagram showing a schematic configuration of a scan driving circuit (driver) of a PDP apparatus according to a third embodiment of the present invention.

The Y driving circuit 102 in FIG. 10 determines a potential at a point A' in the present circuit by switching: the power voltage V1 at a switch SW15; the power voltage V2 at a switch SW18; and the ground (GND) at switches SW16, SW17, similarly to the Y driving circuit 102 of FIG. 5. Capacitors C11, C12 have been previously charged to Vs by switches SW10, SW11, SW16, SW17. By interposing the capacitors C11, C12 after the point A', a voltage of (V3-Vs) and a voltage of (V3+Vs) can be generated. Particularly, the voltage of (V3-Vs) is outputted to the scan driver 303 by turning on a switch SW14, and the voltage of (V3+Vs) is outputted to the scan driver 303 by turning on a switch SW13. The scan driver 303 operates control which is similar to that of the scan driver 303 of FIG. 5.

The circuit for outputting slope waveforms of the reset waveform in TR 31 uses, similarly to FIG. 5, the output circuit of rising-slope waveform 300, the output circuit of falling-slope waveform 301, and the GND clamp circuit 302 so that respective slope waveforms are outputted at the respective output circuits of slope waveforms (300, 301) by a similar control method as the first embodiment. The rising-slope waveform (trp1) 51 in TR 31 as shown in FIG. 4B is outputted by the output circuit of rising-slope waveform 300 through the current path 210, the falling waveform 58 upon switching of the rising-slope waveform (trp1) 51 and the falling-slope waveform (trn1) 52 is outputted through the current path 212, and the falling-slope waveform (trn1) 52 is outputted by the output circuit of falling-slope waveform 301 through the current path 211. In the GND clamp circuit 302 of FIG. 10, as similarly to the GND clamp circuit of FIG. 5, the current noise is reduced by connecting the gate feedback circuit.

[Fourth Embodiment]

Figures 11A, 11B, 11C:
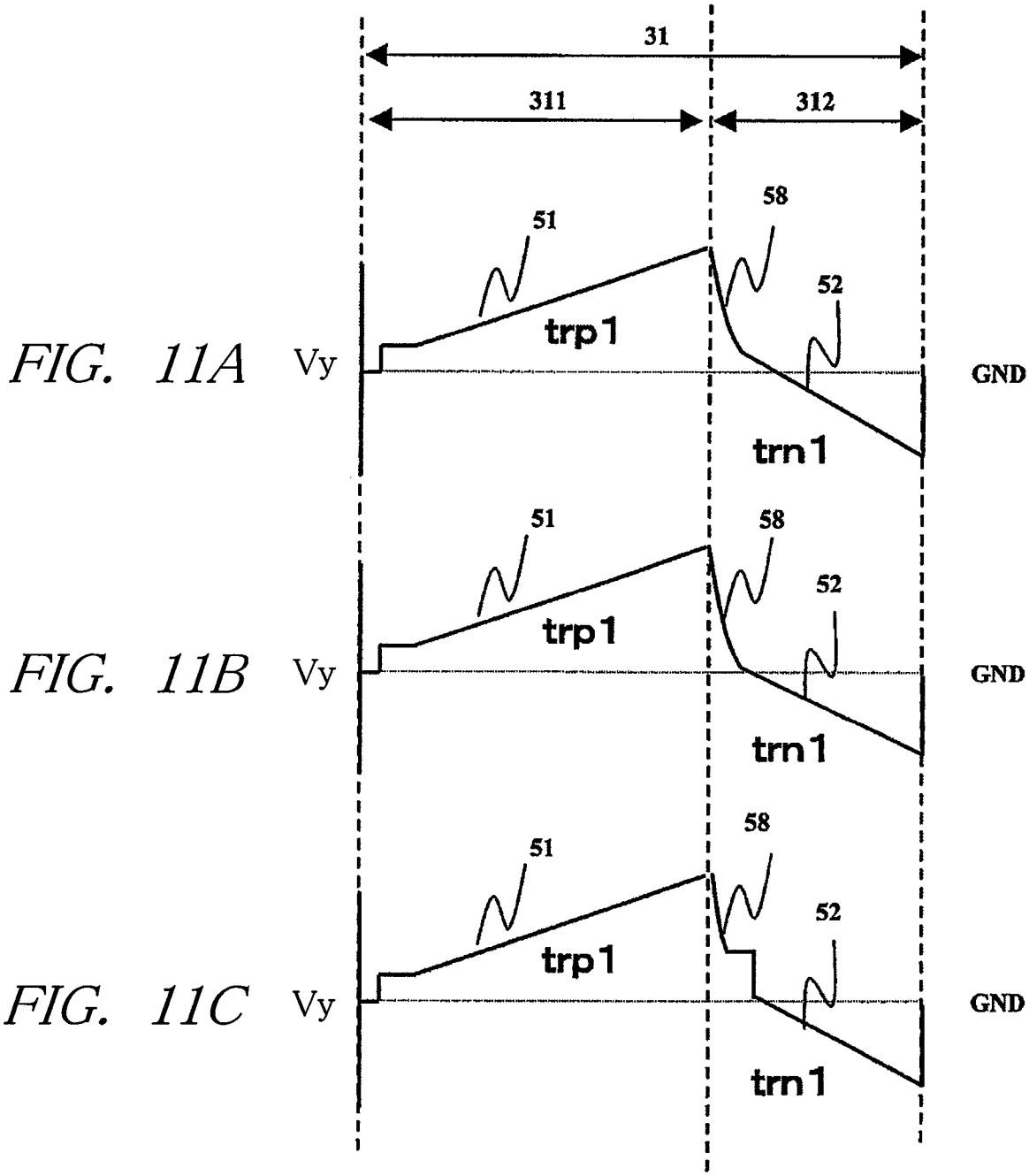
FIG. 11A is diagram showing a voltage waveform of a PDP apparatus according to a fourth embodiment of the present invention.
FIG. 11B is a diagram showing a voltage waveform of the PDP apparatus according to the fourth embodiment of the present invention.
FIG. 11C is a diagram showing a voltage waveform of the PDP apparatus according to the fourth embodiment of the present invention.

FIG. 11A to FIG. 11C show variations of the voltage waveform Vy to be applied to the scan electrode (Y) 12 in TR 31. All the waveforms of FIG. 11A to FIG. 11C can be outputted by the Y driving circuit 102 of FIG. 5 and FIG. 10. FIG. 11A shows a case where the falling upon switching of the rising-slope waveform (trp1) 51 and the falling-slope waveform (trn1) 52 is once dropped to a voltage higher than 0 V (e.g., 50 V) and then the falling-slope waveform (trn1) 52 is applied. FIG. 11B shows a case where the falling upon switching of the rising-slope waveform (trp1) 51 and the falling-slope waveform (trn1) 52 is once dropped to 0 V, and then the falling-slope waveform (trn1) is applied. FIG. 11C shows a case where the power voltage Vs is applied in the midst of the falling upon switching of the rising-slope waveform (trp1) 51 and the falling-slope waveform (trn1) 52 so that the falling is once dropped to Vs, and then the falling-slope waveform (trn1) 52 is outputted. In this manner, the voltage variations between electrodes are mitigated, thereby reducing the current noise.

As described above, according to the present embodiments, by using the gate feedback circuit for a falling upon switching the rising-slope waveform and the falling-slope waveform of the reset waveform in TR 31 of the PDP apparatus 100 and the PDP 10, the current noise occurring in the sustain electrode (X) 11 is reduced and problems such as an increase of unnecessary radiation and large stress upon elements like an FET can be solved.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention is applicable to a technique of a PDP apparatus.

What is claimed is:

1. A plasma display apparatus including at least a first electrode and a second electrode and performing display by using a subfield including a reset period, the plasma display apparatus comprising:

a first driving circuit for applying a voltage waveform to the first electrode;

a second driving circuit for applying a voltage waveform to the second electrode; and a control circuit for controlling the voltage waveform applied to the first and second electrodes by controlling the first and second driving circuits, wherein the first driving circuit includes:

a generation circuit for applying, to the first electrode in the reset period, a rising-slope waveform rising over time until a first voltage;

a generation circuit for applying, in the reset period, a falling-slope waveform falling over time until a second voltage which is lower than the first voltage; and a first clamp circuit for generating, in the reset period, a dulled falling waveform falling over time until a third voltage which is lower than the first voltage and higher than the second voltage between the rising-slope waveform and the falling-slope waveform in the reset period, wherein a voltage change per unit of time of the falling waveform is larger than a voltage change per unit of time of the falling-slope waveform, wherein the second driving circuit includes:

a circuit for applying, to the second electrode in the reset period, a first direct voltage in a period of applying, to the first electrode, the rising-slope waveform;

a circuit for applying, to the second electrode in the reset period, a second direct voltage having a voltage value higher than a voltage value of the first direct voltage in a period of applying, to the first electrode , the falling-slope waveform; and a second clamp circuit for generating, to the second electrode in the reset period, a rising rising-slope waveform rising over time from the voltage value of the first direct voltage until the voltage value of the second direct voltage in the period of applying the falling waveform to the first electrode.

2. The plasma display apparatus according to claim 1, wherein the first clamp circuit comprises a bidirectional switch having at least two switching devices between a plasma display panel and the ground, and wherein a gate feedback circuit is connected to a gate portion of the switching device at the plasma display side.

3. The plasma display apparatus according to claim 2, wherein, in the gate feedback circuit, a capacitor is connected to a high-voltage side of the switching device and an input of a control signal of a gate resistance, and a resistance and a diode connected in parallel are further connected between the gate resistance and the input of the control signal, and wherein the diode is connected forwardly to a gate signal.

4. The plasma display apparatus according to claim 1, wherein the second clamp circuit comprises a switch having at least one switching device, and a gate feedback circuit is connected to a gate portion of the switching device.

5. The plasma display apparatus according to claim 1, wherein the first and second clamp circuits apply a waveform dulled by 100 ns to 1 μs to the first and second electrodes.

6. A plasma display apparatus including at least a first electrode and a second electrode and performing display by using a subfield including a reset period, the plasma display apparatus comprising:

a first driving circuit for applying a voltage waveform to the first electrode; and a control circuit for controlling the voltage waveform applied to the first electrode by controlling the first driving circuit, wherein the first driving circuit includes:

a generation circuit for applying a rising-slope waveform to the first electrode in the reset period;

a generation circuit for applying a falling-slope waveform in the reset period; and a first clamp circuit for generating a dulled falling waveform applied between the rising-slope waveform and the falling-slope waveform in the reset period, wherein the first clamp circuit comprises a bidirectional switch having at least two FETs between a plasma display panel and the ground, and wherein a gate feedback circuit is connected to a gate portion of the FET at the plasma display side, wherein, in the gate feedback circuit, a capacitor is connected to a drain of the FET and an input of a control signal of a gate resistance, and a resistance and a diode connected in parallel are further connected between the gate resistance and the input of the control signal, and wherein the diode is connected forwardly to a gate signal.

7. A plasma display apparatus including at least a first electrode and a second electrode and performing display by using a subfield having an address period and a sustain period, the plasma display apparatus comprising:

a first driving circuit for applying a voltage waveform to the first electrode; and a control circuit for controlling the voltage waveform applied to the first electrode by controlling the driving circuit, wherein the first driving circuit includes:

a circuit for applying a voltage to be a base in the address period;

a circuit for applying a sustain pulse in the sustain period; and a first clamp circuit for generating a dulled waveform applied upon switching from the address period to the sustain period, wherein the first clamp circuit comprises a bidirectional switch having at least two FETs between a plasma display panel and the ground, wherein a gate feedback circuit is connected to a gate portion of the FET at the ground side, wherein, in the gate feedback circuit, a capacitor is connected to a drain side of the FET at the ground side and an input side of a control signal of a gate resistance, and a resistance and a diode connected in parallel are connected between the gate resistance and the input of control signal, and wherein the diode is connected forwardly to a gate signal.

8. A method of driving a plasma display apparatus including at least a first electrode and a second electrode and performing display by using a subfield having a reset period, wherein, in the reset period, the method comprising the steps of:

applying a rising-slope waveform rising over time to the first electrode and applying a first direct voltage to the second electrode in a period of applying the rising-slope waveform;

then applying a falling waveform falling over time for a falling time of 100 ns or longer to 1 μs or shorter to the first electrode from the first voltage until a third voltage that is lower than the first voltage, and applying a rising waveform rising over time for a falling time of 100 ns or longer to 1 μs or shorter to the second electrode from a voltage value of the first direct voltage to a voltage value of a second direct voltage that is higher than the voltage value of the first direct voltage in a period of applying the falling waveform; and then applying a falling-slope waveform falling over time to the first electrode until a second voltage that is lower than the third voltage, and applying the second direct voltage to the second electrode in a period of applying the falling-slope waveform, wherein a voltage change amount per unit time of the failing waveform is larger than a voltage change amount per unit time of the falling-slope waveform.

* * * * *